US006741805B2

(12) United States Patent
Wu

(10) Patent No.: US 6,741,805 B2
(45) Date of Patent: May 25, 2004

(54) FLEXIBLE GRAPHITE FELT HEATING ELEMENTS AND A PROCESS FOR RADIATING INFRARED

(76) Inventor: Bai Wei Wu, No. 10 Industry Area, North Gate, Taishan Guangdong 529200 (CN)

( * ) Notice: Subject to any disclaimer, the term of this patent is extended or adjusted under 35 U.S.C. 154(b) by 0 days.

(21) Appl. No.: 10/141,436

(22) Filed: May 7, 2002

(65) Prior Publication Data

US 2003/0077078 A1 Apr. 24, 2003

(30) Foreign Application Priority Data

Sep. 27, 2001 (CN) ..... 01255970 U
Nov. 8, 2001 (CN) ..... 01349095

(51) Int. Cl.[7] ..... F24D 19/02
(52) U.S. Cl. ..... 392/440; 392/407
(58) Field of Search ..... 392/440, 407; 219/477, 479; 313/112, 111

(56) References Cited

U.S. PATENT DOCUMENTS

| | | | | | |
|---|---|---|---|---|---|
| 3,107,152 | A | * | 10/1963 | Ford et al. | 423/447.2 |
| 3,573,429 | A | * | 4/1971 | Brodbeck et al. | 392/432 |
| 3,665,155 | A | * | 5/1972 | Caroleo | 392/503 |
| 3,835,296 | A | * | 9/1974 | Middough et al. | 219/553 |
| 4,178,530 | A | * | 12/1979 | Lersmacher et al. | 313/337 |
| 4,215,233 | A | * | 7/1980 | Kastilahn | 373/127 |
| 4,271,363 | A | * | 6/1981 | Anderson | 250/504 R |
| 4,327,281 | A | * | 4/1982 | Jager et al. | 219/523 |
| 4,862,137 | A | * | 8/1989 | Javme | 338/237 |
| 5,065,131 | A | * | 11/1991 | Ducourroy et al. | 338/237 |

FOREIGN PATENT DOCUMENTS

| | | | | | |
|---|---|---|---|---|---|
| DE | 4438870 A1 | * | 5/1996 | | H01K/1/10 |
| JP | 2002015711 A | * | 1/2002 | | H01K/7/00 |

* cited by examiner

*Primary Examiner*—Edward K. Look
*Assistant Examiner*—Vinod D. Patel
(74) *Attorney, Agent, or Firm*—Baker & McKenzie

(57) ABSTRACT

A flexible graphite felt heating element and a process for radiating infrared is disclosed.

8 Claims, 1 Drawing Sheet

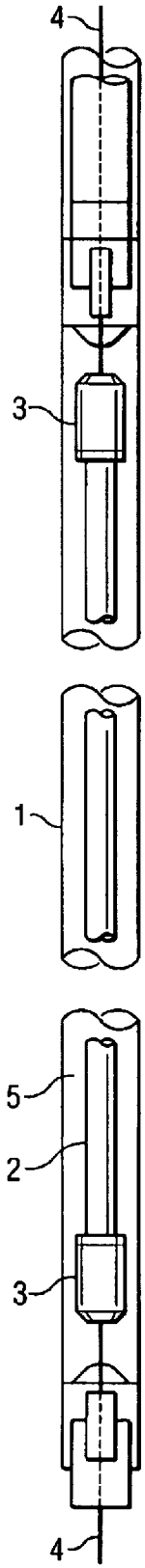
4
3
1
5
2
3
4

FLEXIBLE GRAPHITE FELT HEATING ELEMENTS AND A PROCESS FOR RADIATING INFRARED

BACKGROUND OF THE INVENTION

The present invention relates to a flexible graphite felt heating element and a process for radiating infrared.

Conventionally, a variety of heating elements have been developed for heating various electrical appliances. For example, traditional heating elements use metal housing, quartz glass material. Its current carrying conductor uses metaled heating wires as an electric heat power supply through convection and conduction for inefficiency is experienced. In addition, a carbon group material has beta utilized to effect the rate of heat radiation. For example, Japan patent application 02-133922 discloses a heating element with a conductive film formed on the surface of the base substance made of a carbon group material. In addition, Japan patent application 11-100133 discloses a substrate heating device including a heater made of graphite materials for heating a substrate for forming a thin film and the heater having a shape equivalent to the diameter of a substrate to be heated.

However, there is a need for an efficient radiation heating element which is environmentally safe with concomitant power saving energy consumption and low thermal conductivity. The present invention meets this need.

SUMMARY OF THE INVENTION

One embodiment of the present invention is a flexible graphite felt heating element comprising:

(a) a flexible graphite felt material having a low ash content inserted in a vacuumized glass housing;

(b) at least a pair of electrodes attached to the flexible graphite felt; and (c) a sealed glass housing.

Optionally, an inactive gas may be sealed in the glass housing.

Another embodiment of the present invention is a process for radiating infrared comprising the steps of:

(a) pig a flexible graphite felt inside a glass housing;

(b) vacuuming the glass housing;

(c) connecting at least a pair of electrodes to the flexible graphite felt;

(d) sealing the glass housing with an inactive gas; and (e) radiating infrared rays having a wavelength in the range of about 4 to 100 microns.

The present invention achieves low thermal conductivity, has a substantially uniform structure and allows for rapid heating efficiency. Energy savings of up to about 75% are realized over conventional heater elements and radiating infrared methods.

Details of one or more embodiments of the invention are set forth in the description below. These embodiments are for illustrative purposes only and the principle of invention can be implemented in other embodiments. Other features and advantages of this invention will become apparent from the following description

BRIEF DESCRIPTION OF THE DRAWINGS

FIG. 1 is flexible graphite felt heating element of the present invention.

DETAILED DESCRIPTION OF THE INVENTION

The flexible graphite felt heating elements may be produced in various shapes, sizes and dimensions. One preferred shape is a strip, elongated or linear piece. It has a substantially uniform structure, that is, smooth, flat over long lengths, preferably 25 meters and substantially uniform thickness resulting in constant insulating properties. The flexible graphite felt heating elements may be assembled in various electrical appliances including but not limited to an electric heater, warmers, air conditioners, ovens and the like. Furthermore, electrostatic charging is minimized when the present invention is used together with plastics in composite materials. The intensity of radiant infrared has a wavelength of 4 to 100 microns, preferably 6 to 14 microns and exhibits antibacterial, antifungus and beneficial health results.

The flexible graphite felt heating element having an elongated shad is placed inside a glass made housing 1. The flexible graphite felt 2 can be a fibred material or the like. The housing can be glass, quart glass, ceramic and the like. Preferably, each end of the flexible graphite felt is connected to an electrode 3. The electrode could be assembled using a metal material selected from the group consisting of molybdenum, tungsten or the like in the form of a molybdenum sheet or molybdenum wire 4. It will be appreciated the material of the electrode could be assembled using other comparable metal materials. A ceramic ring is inserted at the end of the glass tube trough which the electrode is lead out by another piece of metal wire. The evacuation of the housing is done by the vacuum and heating as described in "Technology of Vacuum", China United Book No. 15290.388, page 51 (1986), the teachings of which are incorporated by reference. Inactive gas 5 or another material resistance to oxidation is optional and may be filled into the glass tube which is then sealed. The inactive gas can be argon helium or the like. The housing is ten sintered at a temperature of about 1300 to 1600° C. and sealed, as described in "Handbook of Vacuum Designs", 2nd edition, page 1177 (1996), the teachings of which are incorporated herein by reference.

Now referring to the drawing, FIG. 1 is one embodiment of a flexible graphite felt heating element of the present invention. The flexible graphite felt 2 is housed within a quartz glass tube 1. The electrode 3 is at the each end of the elongated flexible graphite felt and the electrode 3 is connected to a wire 4. The inactive gas 5 is filled into the glass tube 1 which is sealed.

Another embodiment of the present invention is a process for radiating infrared comprising the steps of placing manually a flexible graphite felt inside a glass housing. Next a technique as described above to evacuate the housing such as by vacuuming, heating or the like is followed by connecting electrodes by molybdenum wire to each end of the flexible graphite felt as described in "Technology of Vacuum" page 151, the teachings of which are incorporated herein by reference. This step is followed by sealing the glass housing by way of sintering at a temperature of 1300 to 1600° C. and radiating infrared rays having a wavelength in the range of about 4 to 100 microns, preferably 6 to 14 microns.

The flexible graphite felt is generally commercially available and may be manufactured by graphitization of carbon felt. This process makes for smaller specific surface areas and greatly reduced pump-down times under high vacuum. A very low ash content of about 0.01 to about 0.06%, preferably about 0.03 to about 0.05%, based on the total weight of the 400 gram to 1100 gram per square meter is indispensable for high purity materials in production plants and ensures high oxidation resistance of graphite felts. Experimental testing exemplifies that the graphite felt heating element has a long life and can be con ed in excess of 30,000 hours.

Those skilled in the art will appreciate that many widely different embodiments of the present invention may be adopted without departing from the spirit and scope of the invention.

What is claimed is:

1. A flexible graphite felt heating element comprising:

(a) a flexible graphite felt material having an ash count in the range of about 0.01% to about 0.06% inserted in a vacuumized glass housing;

(b) at least a pair of electrodes attached to the flexible graphite felt; and (c) a sealed glass housing.

2. The flexible graphite felt heating element of claim 1, further comprising:

(d) an inactive gas sealed in the glass housing.

3. The heating element of claim 2 wherein the glass housing comprises a material selected from the group consisting of glass, quartz glass and ceramic.

4. The heating element of claim 1 or claim 3 wherein the electrode comprises a material selected from the group consisting of molybdenum and tungsten.

5. The heating element of claim 4 wherein the pair of electrodes is positioned at respective ends of the flexible graphite felt by a molybdenum wire.

6. The heating element of claim 2 wherein the inactive gas comprises a gas selected from the group consisting of argon and helium.

7. An electrical appliance comprising the flexible graphite felt heating element of claim 1.

8. The heating element of claim 1, wherein the flexible graphite felt material has an ash count in the range of about 0.03% to about 0.05%.

* * * * *